United States Patent [19]

Dupret et al.

[11] Patent Number: 5,077,800

[45] Date of Patent: Dec. 31, 1991

[54] ELECTRONIC DEVICE FOR PROCESSING A SOUND SIGNAL

[75] Inventors: Jean-Pierre Dupret, Trevenans-Nord; Frank Lefevre, Dijon, both of France

[73] Assignee: Societe Anonyme dite:Laboratorie D'Audiologie Dupret-Lefevre S.A., Montebeliard, France

[21] Appl. No.: 416,850

[22] Filed: Oct. 4, 1989

[30] Foreign Application Priority Data

Oct. 14, 1988 [FR] France ..... 88 13541

[51] Int. Cl.[5] ..... H04R 25/00

[52] U.S. Cl. ..... 381/68.2; 381/68.4

[58] Field of Search ..... 381/68.2, 68, 68.4, 381/98, 100, 101, 102, 50

[56] References Cited

U.S. PATENT DOCUMENTS

| | | | |
|---|---|---|---|
| 3,818,149 | 6/1974 | Stearns et al. | 381/68.2 |
| 3,855,416 | 12/1974 | Fuller | 381/41 |
| 4,187,183 | 2/1980 | Moser | 381/68 |
| 4,637,402 | 1/1987 | Adelman | 381/68.2 |
| 4,953,216 | 8/1990 | Beer | 381/68.2 |

FOREIGN PATENT DOCUMENTS 1230466 12/1966 Fed. Rep. of Germany .

OTHER PUBLICATIONS

IEEE Transactions on Audio and Electroacoustics, vol. AU-17, No. 4, Dec., 1969, pp. 290-297, "A Critical Review of Work on Speech Analyzing Hearing Aids".

Patent Abstracts of Japan, vol. 10, No. 99 (E-396) [2156], 16 Apr. 1986.

*Primary Examiner*—Forester W. Isen

*Assistant Examiner*—M. Nelson McGeary, III

*Attorney, Agent, or Firm*—Marshall, O'Toole, Gerstein, Murray & Bicknell

[57] ABSTRACT

The present invention concerns an electronic device for processing a sound signal, said device being of the type comprising: means for receiving said sound signal and for transforming it into an electric signal, means for processing said electric signal, and means for restoring a modified sound signal from said processed electric signal. According to the invention, the device includes means (8) for selecting at least one band of frequencies of said signal, said means being disposed between said means (1) receiving the sound signal and said processing means (10) of the corresponding electric signal. In particular, the invention is applicable to hearing aids.

10 Claims, 6 Drawing Sheets

ELECTRONIC DEVICE FOR PROCESSING A SOUND SIGNAL

FIELD OF THE INVENTION

The present invention concerns an electronic device for processing a sound signal.

BACKGROUND OF THE INVENTION

Although not exclusively, the invention applies more particularly to correcting the hearing problems of a patient and the device of the invention can thus be used as a portable hearing aid.

Generally speaking, conventional hearing aids comprise an input microphone, amplification means and an output earpiece. Amplification is embodied throughout the entire spectrum of frequencies. Firstly, this proves to be superfluous as, for each individual patient, specific zones of the spectrum are best conserved, and secondly may be harmful owing to the fact that accordingly no differentiation exists between the "useful" frequencies and the other frequencies.

Furthermore, it appears that, as regards certain pathological ears, a loss of hearing is expressed by an inability of the ear, not of actually being able to hear, but of being unable to correctly identify the sound emitted. Moreover, clinical tests show that this inability to correctly identify sounds is more or less marked according to the zones of frequencies involved and varies according to the type and form of the loss of hearing particular to each patient. In a seriously affected hearing zone, a sound signal having given frequencies may then be received as a signal presenting different frequencies and, as a result, the sound "heard" by the patient may appear to differ from the sound transmitted. For example, the patient will hear an "S" for an "F", and vice versa. Owing to this, a sound signal, even if amplified, still risks being poorly received by the pathological ear which somehow distorts the sound transmitted, regardless of the intensity of said sound.

Thus, the frequencies of the sound spectrum have been considered as being shifted by a whole octave number equal to at least one. (It is clearly understood that the term "octave" as used here represents the interval of two vibrations, one of which has a frequency twice the other vibration). The frequencies of the signal may then occur in a more favorable zone, namely the best preserved hearing zone of the pathological ear. Furthermore, as the frequencies of the signal are shifted by one octave, the corresponding sound shall still be able to be recognised, even if it is noticed as being more low-pitched or more high-pitched.

However, in this case, all the frequencies of the spectrum also undergo this shift which, in the last analysis, results in drawbacks similar to those indicated previously.

SUMMARY OF THE INVENTION

The object of the present invention is to overcome these drawbacks and concerns a device for processing a sound signal making it possible to improve the perception of sounds in difficult conditions and especially with patients affected by hearing problems.

To this effect, the electronic device for processing a sound signal and being of the type comprising:

means for receiving the sound signal and for transforming it into an electric signal, means for processing said electric signal, and means for restoring a modified sound signal from said processed electric signal is notable that, according to the invention, it includes means to select at least one band of frequencies of said signal, said means being disposed between said means for receiving the sound signal and said means for processing the corresponding electric signal.

Accordingly, the signal is only processed in the band (or possibly the bands of frequencies) in which a patient suffers from hearing problems, said band being determined by a prior examination of the patient.

Advantageously, said means for selecting a band of frequencies are connected in parallel to a link connecting said means for receiving the sound signal and said means for restoring the signal, and means are also provided to add the signal received and the processed signal.

In a first case, said processing means are adapted so as to amplify the signal in said frequency band.

In a device specially adapted to voice processing, said means for processing the electric signal include means for detecting at least one amplitude peak of said signal and means for amplifying said peak, so that the restored sound signal, constituted by superposition of the received sound signal and said amplified peak, presents a more marked emergence of said peak. This makes it easier for the patient to recognise the morpheme structures (corresponding to the amplitude peaks) of a vowel or consonant.

Advantageously, said selection and processing means comprise at least one series of elements successively comprising a bandpass filter, a limiter amplifier and a reconstruction filter.

Preferably, a control line connects the output of the bandpass filter to intensity adjustment means provided downstream of the reconstruction filter. The processed signal shall thus exhibit an amplitude proportional to that of the input signal.

In a second case, said processing means are adapted so as to shift the frequencies of said band under the control of said frequency selection means by a whole octave at least equal to one.

Firstly, said processing means may comprise means able to create a signal, each frequency of said signal being half the corresponding frequency of the signal received.

Secondly, said processing means may comprise means able to create a signal, each frequency of said signal being double those of the signal received.

In the second case, the device preferably comprises:

a bandpass filter disposed between said means for receiving the sound signal and said processing means, and means receiving the output signal of the bandpass filter and intended to control said processing means.

In particular, said control means may comprise a limiter amplifier.

In addition, said control means may comprise a circuit for digitalizing the signal, said circuit being disposed between said limiter amplifier and said means for processing the signal.

Furthermore, filtering means may be provided between said signal processing means and the adding means.

Moreover, the device may comprise means to add the received signal and the processed signal in a selected frequency band, firstly amplified and secondly frequency shifted by a whole octave number equal at least to one.

Advantageously, the device also includes means for adjusting the intensity of the processed signal with respect to that of the signal received.

BRIEF DESCRIPTION OF THE DRAWINGS

The figures of the annexed drawing clearly reveal how the invention may be embodied. Identical references on these figures denote similar elements.

DETAILED DESCRIPTION OF THE PREFERRED EMBODIMENTS

Figure 1:
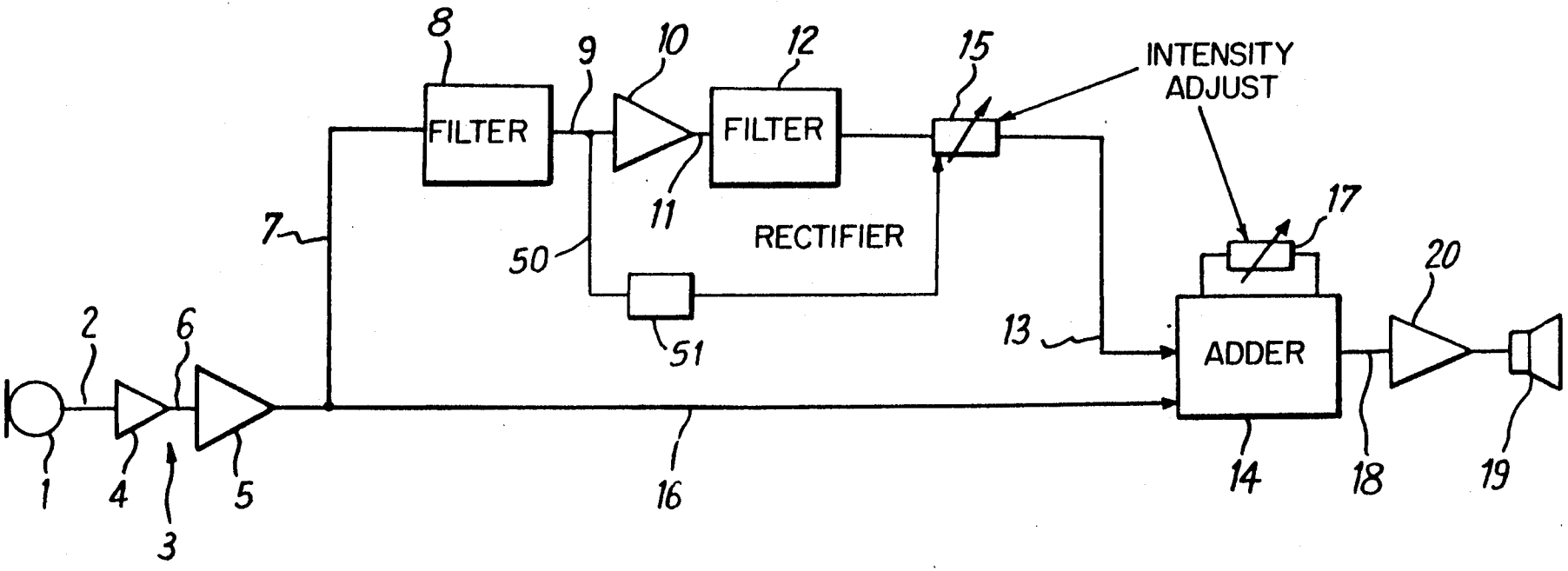
FIG. 1 is a synoptic diagram of an embodiment example of the device according to the invention.

As already indicated, the electronic device may appear in the form of a portable hearing aid.

In all the embodiment examples represented above, the device includes a microphone 1 connected via a link 2 to amplification means 3 able to include a preamplifier 4 and an amplifier 5 connected by a link 6.

In the embodiment example of FIG. 1, the output of the amplifier 5 is connected by a link 7 to the input of a bandpass filter 8 whose frequency band is selected according to the affected hearing zone particular to each patient and which has been determined by means of a prior examination. For example, the frequency band of between 750 Hz and 2500 Hz could be considered. The bandpass filter 8 is itself connected by a link 9 to a limiter amplifier 10 itself connected by a link 11 to a reconstruction filter 12. The output of the filter 12 is connected by a link 13 to a first input of the adding means 14 via intensity adjustment means 15.

Furthermore, a control line 50 connects the output of the bandpass filter 8 to the intensity adjustment means 15 by means of a rectifier 51. The amplitude of the input signal thus "controls" the intensity adjustment at the output of the reconstruction filter so that the processed signal routed to the adding means 14 has an amplitude proportional to that of the input signal.

In addition, the output of the amplifier 5 is directly connected to a second input of the adding means 14 by means of a link 16.

The adding means 14 may also be provided with intensity adjustment means 17. Furthermore, the output of the adding means 14 is connected by the link 18 to a ear piece 19, possibly via a "push-pull" type amplifier 20.

There now follows an explanation of the functioning of this embodiment example of the device according to the invention, used in particular as a hearing aid.

The sound signal picked up by the microphone 1 is transformed into an electric signal, the latter being routed by the link 2 to the amplification means 3.

Then the signal is routed by the link 7 to the bandpass filter 8 only allowing the band of frequencies selected from the spectrum to pass, said frequency band then being amplified and restored into the limiter amplifier 10 and the reconstruction filter 12. The signal thus created is routed to the adding means 14 where it is added to the amplified input signal.

In the case where the device is more particularly adapted to voice processing, the processing means of the electric signal make it possible to detect at least one amplitude peak of said signal (said peak being representative of the first or second morpheme structures of a vowel or consonant) and to amplify said peak, so that the restored sound signal, constituted by the superposition of the sound signal received and said amplified peak, presents a more marked emergence of the peak, which helps the patient to recognise the morpheme structures (corresponding to the amplitude peaks) of a particular vowel or consonant.

Figure 2:
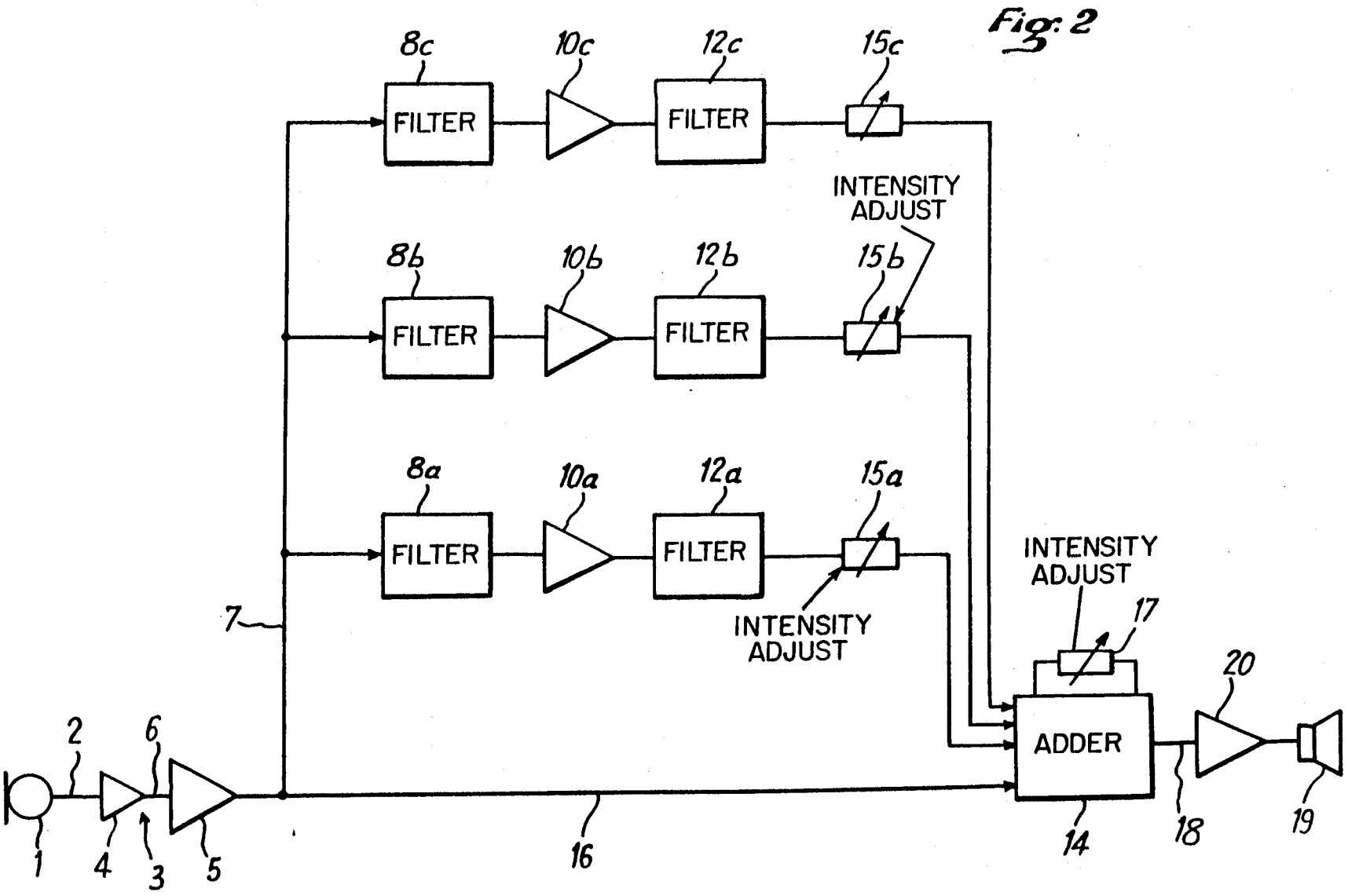
FIG. 2 illustrates an embodiment variant of FIG. 1.

FIG. 2 represents an embodiment variant of the device of FIG. 1. This figure shows the use of three series of elements, each successively comprising a bandpass filter 8*a*, 8*b*, 8*c*, a limiter amplifier 10*a*, 10*b*, 10*c* and a reconstruction filter 12*a*, 12*b*, 12*c*. Moreover, intensity adjustment means 15*a*, 15*b*, 15*c* are provided for each of said series. Three series of elements have been represented, but this need not be regarded as restrictive. Generally speaking, several series of elements may be used. In this case, each bandpass filter 8*a*, 8*b*, 8*c* works in a particular zone of frequencies, such as, for example, 200–750 Hz, 750–2500 Hz and 2500–5000 Hz respectively, thus covering a wider band of frequencies.

Figure 3:
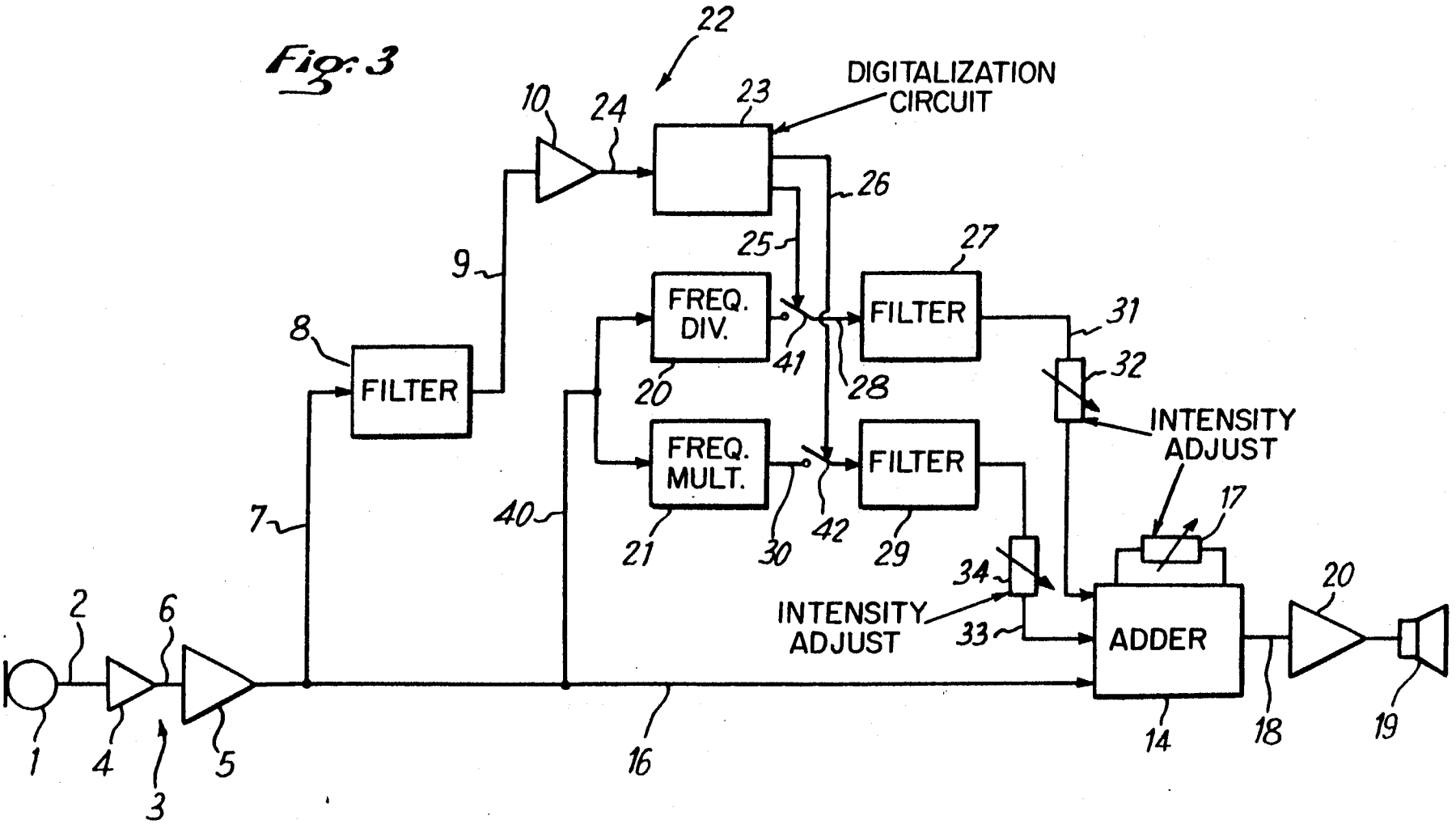
FIG. 3 is a synoptic diagram of another embodiment example of the device of the invention.
Figure 4:
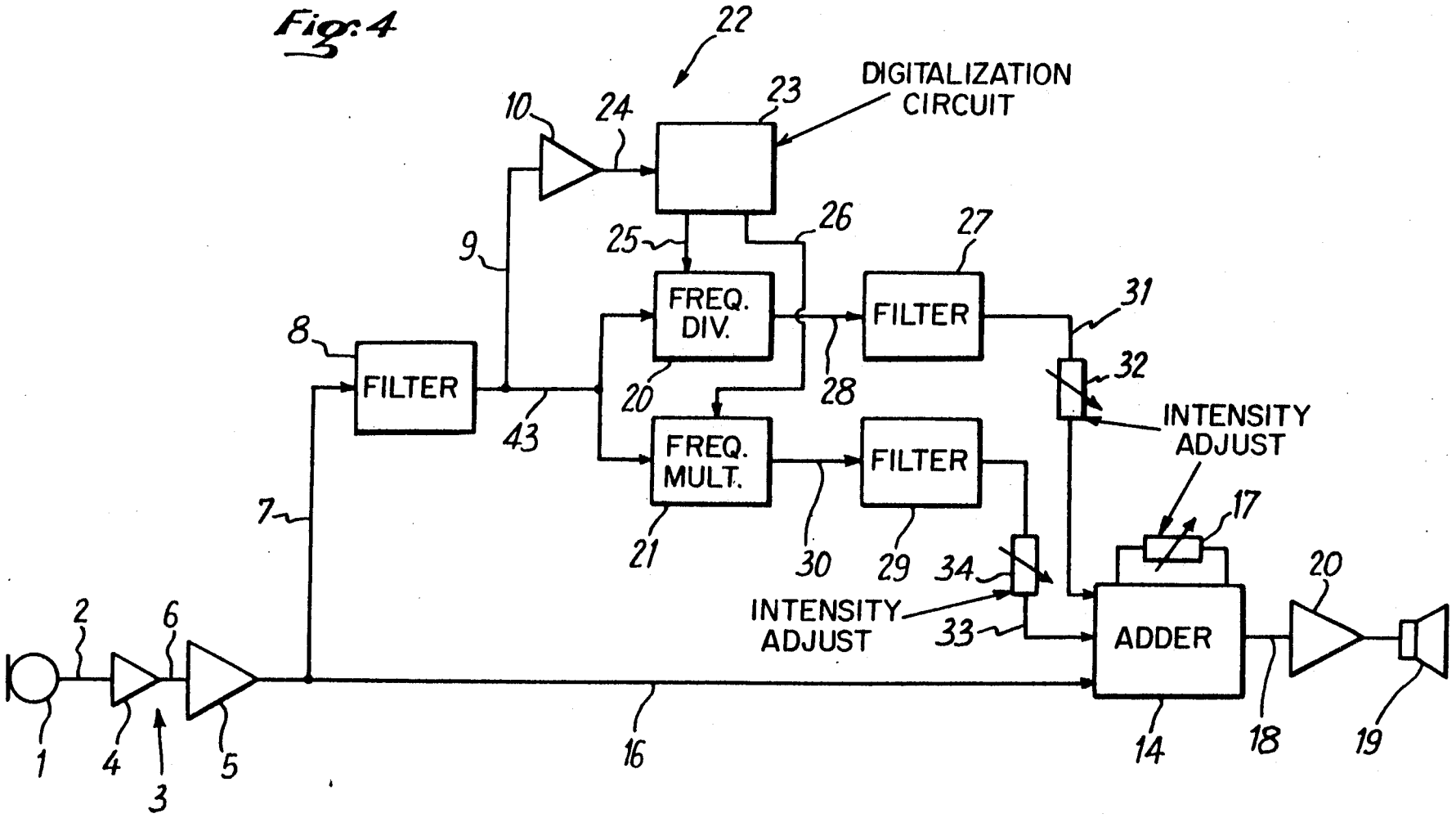
FIG. 4 illustrates an embodiment variant of the device of FIG. 3.

Reference is now made to the embodiment examples of FIGS. 3 and 4 in which the device of the invention similarly includes a microphone 1 connected by a link 2 to amplification means 3 able to include a preamplifier 4 and an amplifier 5 connected by a link 6.

The output of the amplifier 5 is also connected by a link 7 to the input of a bandpass filter 8 whose frequency band is selected according to the affected hearing zone particular to each patient (or this selection results from a compromise between the various affected hearing zones), said band having been determined by means of a previous examination of the patient.

In the case of FIG. 3, the output of the bandpass filter 8 is connected by the control link 9 to means 22 for controlling frequency dividing means 20 and frequency multiplying means 21. These means 20 and 21 are able to respectively divide or multiply by two a given frequency, namely shift said frequency by one octave respectively towards low-pitched sounds or towards high-pitched sounds.

The frequency could also be shifted by two, three, etc., octaves towards the low-pitched sounds or the high-pitched sounds. Moreover, the frequency dividing means 20 and frequency multiplying means 21 are connected to the output of the amplifier 5 by a power link 40.

The control means 22 include a limiter amplifier 10 connected to the output of the filter 8 by the link 9 and to the input of the digitalization circuit 23 of the signal by a link 24. Via the links 25 and 26, this circuit acts on the switches 41 and 42 respectively connected to the outputs of the dividing means 20 and frequency multiplying means 21, said means 20 and 21 functioning continuously.

In addition, the output of the frequency dividing means 20 is connected to a reconstruction filter 27 by the link 28, whereas the output of the frequency multiplying means 21 is connected to a reconstruction filter 29 by the link 30 via said switches 41 and 42 respectively.

The output of the filter 27 is connected by the link 31 to a first input of the adding means 14 via intensity adjustment means 32. Similarly, the output of the filter 29 is connected by the link 33 to a second input of the adding means 14 via intensity adjustment means 34.

Furthermore, the output of the amplifier 5 is directly connected to a third input of said adding means 14 by a link 16. The output of the adding means 14 is connected, as in the case of FIG. 1, to the earpiece 19 via the amplifier 20.

In the variant of FIG. 4, the output of the bandpass filter 8 is connected by the power link 43 to the frequency dividing means 20 and the frequency multiplying means 21 which in this case only function in the frequency band defined by the filter 8. As in the case of FIG. 3, the output of the filter 8 is also connected by the control link 9 to means 22 for controlling said frequency dividing means 20 and frequency multiplying means 21.

The control means 22 also include a limiter amplifier 10 connected to the output of the filter 8 by the link 9 and to the input of a circuit 23 for digitalizing the signal by a link 24. The circuit 23 is connected to the frequency dividing means 20 and to the frequency multiplying means 21 by the links 25 and 26 respectively.

The remainder of the device is identical to the corresponding part of the device of FIG. 3 described above.

Figure 5:
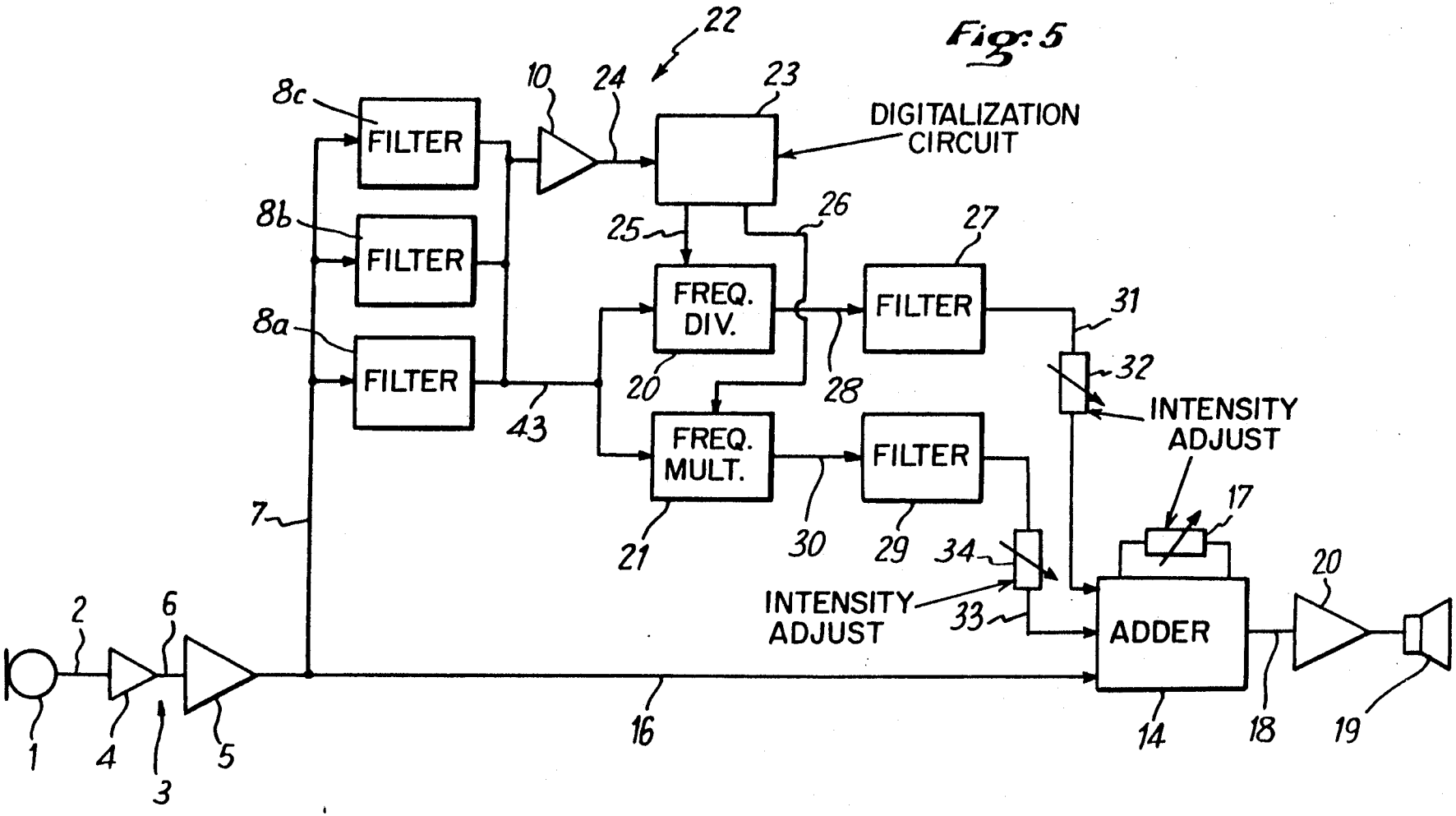
FIG. 5 illustrates an embodiment variant of the device of FIG. 4.

In the case of FIG. 5, three bandpass filters 8*a*, 8*b*, 8*c* are provided and work in three separate frequency zones, as for the variant of the device of FIG. 1 shown on FIG. 2 and for the same reasons (the filters 27,29 are then of course adapted to the bandpass filters 8*a*, 8*b*, 8*c*). Such a variant shown for the device of FIG. 4 could quite clearly be also applied to the device of FIG. 3.

There now follows a description of the functioning of the embodiment examples of the device shown on FIGS. 3 to 5.

The sound signal picked up by the microphone 1 is transformed into an electric signal which is then routed by the link 2 to the amplification means 3.

In the case of FIG. 3, the power of the signal is transmitted to the frequency diving means 20 and frequency multiplying means 21 by the link 40, said means 20 and 1 functioning continuously. The switches 41 and 42 are controlled by the control means 22 under the control of the bandpass filter 3 which works on a frequency width adapted to the patient, said width being, for example, of between 750 Hz and 2500 Hz.

In the case of FIG. 4, the power of the signal is routed to the dividing means 20 and frequency multiplying means 21 by the link 43 and via the bandpass filter 8. The means 20 and 21 only "work" for those frequencies belonging to the selected band of frequencies (for example, between 750 Hz and 2500 Hz), the division or multiplication for example by two of the frequencies in said band being controlled by the control means 22.

The output signal of the frequency dividing means and the frequency multiplying means is therefore a signal created from the signal received exhibiting, in the band of selected frequencies, frequencies shifted by one octave (possibly by two octaves or more) respectively towards low-pitched sounds or high-pitched sounds with respect to the frequencies corresponding to the signal received. The created signal then passes into the filters 27, 29 so as to eliminate any undesired harmonic distortions before being routed to the adding means 14. The relative amplitudes of the output signal of the frequency dividing means and of the output signal of the frequency multiplying means may be adjusted by means of the adjustment means 32 and 34.

The amplified input signal is also sent directly to the adding means 14 where said input signal and created signal are added so as to provide a general output signal routed to the earpiece 19 via the amplifier 20.

At the output of the device, the signal is thus constituted by:

the amplified input signal, a created signal whose frequencies in the frequency band of the bandpass filter are shifted by one octave (possibly by two octaves or more) towards the low-pitched sounds with respect to the corresponding frequencies of the input signal, and/or a created signal whose frequencies in the frequency band of the bandpass filter are shifted by one octave (possibly by two octaves or more) towards the high-pitched sounds with respect to the corresponding frequencies of the input signal.

The functioning of the device of FIG. 5 is identical to that of the devices of FIGS. 3 and 4, except that several bands of frequencies can be selected by the various filters 8*a*, 8*b* and 8*c*.

Figure 6:
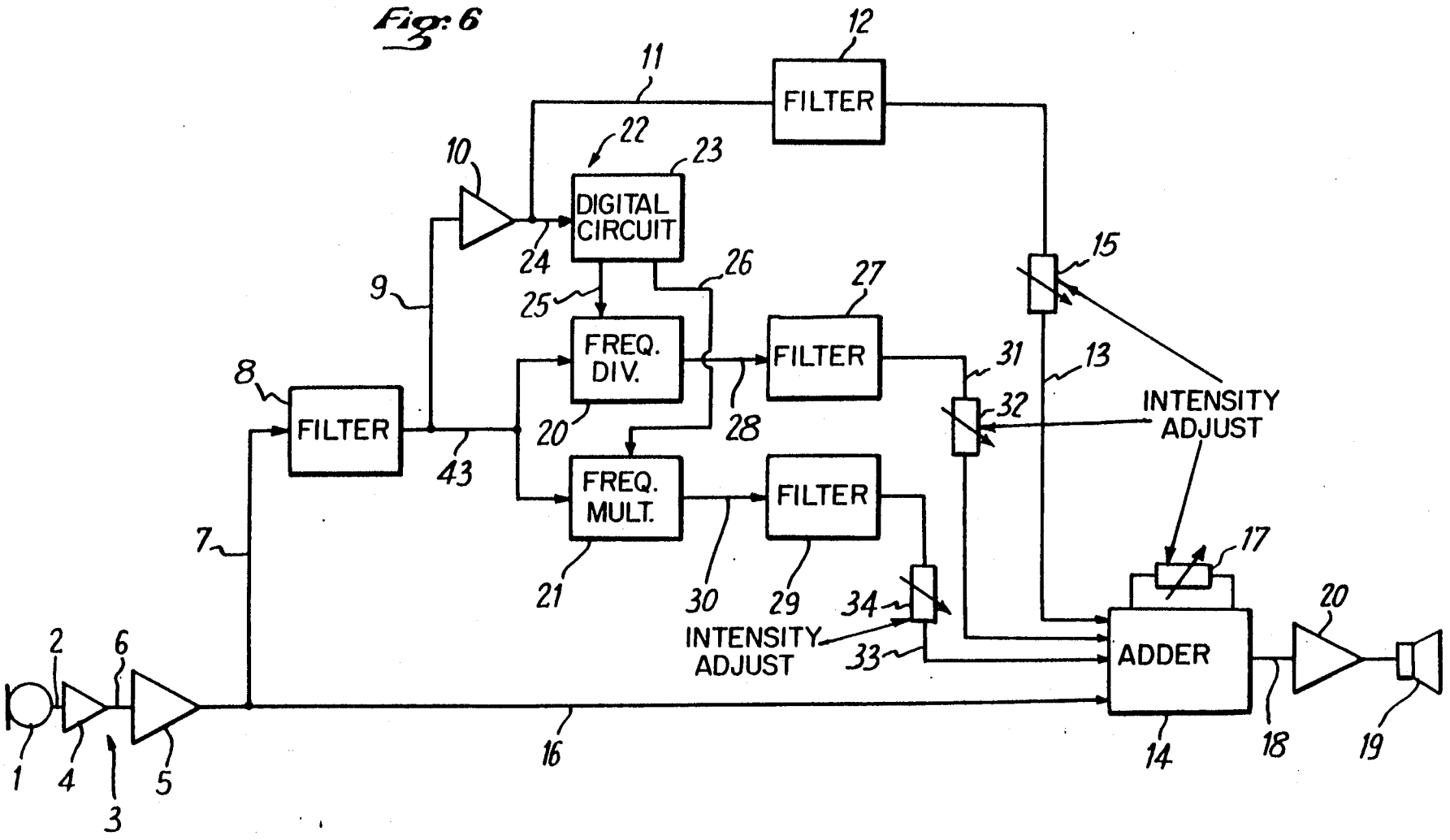
FIG. 6 is a synoptic diagram of a device combining the processings of the signal carried out in the devices of FIGS. 1 and 3 or 4.

In the variant of FIG. 6, the device combines the processings of the signal effected in the devices of FIGS. 1 and 4. In this case, the adding means 14 are specially adapted to add the received signal (link 16) and the processed signal in a selected band of frequencies (bandpass filter 8), firstly amplified (link 13) and secondly shifted onto frequencies by a whole octave number equal at least to one (links 31, 33).

What is claimed is:

1. Electronic device for processing a sound signal particularly adapted to voice processing, comprising:

input means for receiving the sound signal and transforming said sound signal into an electric signal, comprising amplification means for amplifying said electric signal, processing means coupled to the output of said input means for processing said electric signal and transforming it into a processed electric signal, said processing means comprising means to detect at least one amplitude peak of said electric signal including frequency selection means for selecting at least one frequency band of said electric signal and means for amplifying said peak;

summation means coupled to outputs of said input means and said processing means for adding said electric signal and said processed electric signal into a combined processed electric signal, so that the signal, constituted by the superposition of said electric signal and said amplified peak, presents a more marked emergence of said peak and output means for restoring a modified sound signal from said combined processed electric signal.

2. Device according to claim 1 wherein said processing means comprises at least one series of elements comprising a bandpass filter, a limiter amplifier and a reconstruction filter.

3. Device according to claim 2, wherein a control line connects the output of the bandpass filter to intensity adjustment means provided downstream of the reconstruction filter.

4. Device according to claim 1, wherein said processing means are adapted so as to shift the frequencies of said band under the control of said frequency selection means by a whole octave number at least equal to one.

5. Device according claim 4, wherein said processing means comprise means able to create a signal, each frequency of said signal being half the corresponding frequency of the received signal.

6. Device according to claim 4, wherein said processing means comprise means able to create a signal, each of whose frequencies are double those of the received signal.

7. Device according to claim 4, wherein it comprises control means receiving the output signal of the band-pass filter, said control means being intended to control said processing means.

8. Device according to claim 7, wherein said control means comprise a digitalization circuit.

9. Device according to claim 4, wherein it includes means for adjusting the intensity of the processed signal.

10. Device according to claim 1, wherein it appears in the form of a portable hearing aid.

* * * * *